United States Patent [19]

Olson

[11] Patent Number: 4,618,026

[45] Date of Patent: Oct. 21, 1986

[54] APPARATUS AND METHOD FOR PRODUCING A COUNTERACTING FORCE

[75] Inventor: Wayne L. Olson, Evergreen, Colo.

[73] Assignee: Rose Manufacturing Company, Englewood, Colo.

[21] Appl. No.: 781,402

[22] Filed: Sep. 27, 1985

[51] Int. Cl.[4] ..... A62B 35/00

[52] U.S. Cl. ..... 182/4; 188/371; 244/151 R; 297/472

[58] Field of Search ..... 182/3, 4, 5–8; 188/371, 65.1, 65.4; 244/151 R, 151 B, 147; 297/470, 471, 472

[56] References Cited

U.S. PATENT DOCUMENTS

| | | | |
|---|---|---|---|
| 3,444,957 | 5/1969 | Ervin | 182/3 |
| 3,547,468 | 12/1970 | Giuffrida | 297/472 |
| 3,550,957 | 12/1970 | Radke | 297/472 |
| 3,804,698 | 4/1974 | Kinloch | 182/3 |
| 3,891,272 | 6/1975 | Takada | 297/472 |
| 3,937,407 | 2/1976 | Matsuo | 244/151 R |
| 4,446,944 | 5/1984 | Forrest | 182/3 |
| 4,515,254 | 5/1985 | Markov | 297/472 |
| 4,538,702 | 9/1985 | Wolner | 182/3 |

FOREIGN PATENT DOCUMENTS

| | | |
|---|---|---|
| 2460163 | 12/1974 | Fed. Rep. of Germany . |
| 816821 | 4/1981 | U.S.S.R. . |

*Primary Examiner*—Reinaldo P. Machado
*Attorney, Agent, or Firm*—Klaas & Law

[57] ABSTRACT

Apparatus and method for applying a counteracting force which is generated by pulling superposed sections of webbing, which are secured together, through a separating means so that the separation of the secured together superposed sections generates a counteracting force. A frictional force may also be generated so as to provide an additional counteracting force.

28 Claims, 13 Drawing Figures

APPARATUS AND METHOD FOR PRODUCING A COUNTERACTING FORCE

FIELD OF THE INVENTION

This invention relates generally to apparatus and method for producing a counteracting force so as to overcome a force acting on an object and is more particularly directed to apparatus and method for producing a counteracting force for use as a shock absorber and in particular a shock absorber for use with safety harnesses.

BACKGROUND OF THE INVENTION

Under normal working conditions, a workman, when working on a scaffold, catwalk or other devices positioned in a relatively high place where a fall could result in serious injury, will wear some type of a safety device. One such device is illustrated in U.S. Pat. No. 3,444,957 to R. G. Ervin, Jr. which discloses a safety harness having a folded web which has been stitched together and which is adapted to be ripped apart in checking the fall of a workman. Another type of device is illustrated in U.S. Pat. No. 4,100,996 to J. E. Sharp which discloses a safety harness having a free reach of webbing that is pulled through a three bar slide to provide the necessary resistance to decelerate the fall. While these devices have performed satisfactorily, the industry is continuously looking for better devices to ensure that a workman escapes injury in the event of a fall. A desirable device is one that is small in size so that the workman will not be hindered in his working efforts; that will not cause a severe initial shock; that will apply a uniform force of sufficient magnitude so that the fall will be decelerated to a complete stop without a final severe shock; and that cannot be incorrectly attached to cooperating structures.

SUMMARY OF THE INVENTION

This invention provides apparatus and method for producing a counteracting force wherein superposed sections of webbing which are secured together by suitable means, such as by stitching, are pulled over a separating means by a force applied thereto so that successive portions of the superposed sections are separated so as to generate a counteracting force which is continued to be generated until the force applied to the superposed sections has been overcome. The invention also provides apparatus and method for producing a frictional force which cooperates to provide an additional counteracting force.

In a preferred embodiment of the invention, the apparatus comprises a portion of an elongated strip of webbing which is folded over so as to form superposed sections of the webbing which may be secured together by suitable means, such as by stitching. Means are provided adjacent one end of the superposed sections for securing the apparatus to a first object. A separating means is provided and is positioned so that the separating means can pass between the superposed sections. Means are provided for securing the separating means to a second object. The apparatus operates in response to a force causing relative movement between the first and second objects in a direction away from one of the first or second objects. When the force is of sufficient magnitude, the superposed sections will be pulled over the separating means so that successive portions of the superposed sections will be separated. The separation of the superposed sections generates a counteracting force against the force pulling the superposed sections over the separating means. The counteracting force continues to be generated until the force causing the relative movement between the first and second objects has been overcome and the relative movement has been stopped. In some instances, means are provided to generate frictional forces which also counteract the force causing the relative movement between the first and second objects. In a preferred embodiment of the invention, two rings cooperate with the elongated strip of webbing and the secured together superposed sections to provide a separating means to generate a counteracting force and a friction applying means to generate an additional counteracting force.

It is an object of this invention to provide apparatus and method for producing a counteracting force by pulling secured together, superposed sections of webbing over a separating means so that separation of the superposed sections generates a counteracting force.

It is another object of this invention to provide apparatus and method for producing a counteracting force by pulling secured together, superposed sections of webbing over a separating means in association with a friction applying means so as to generate an additional counteracting force.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
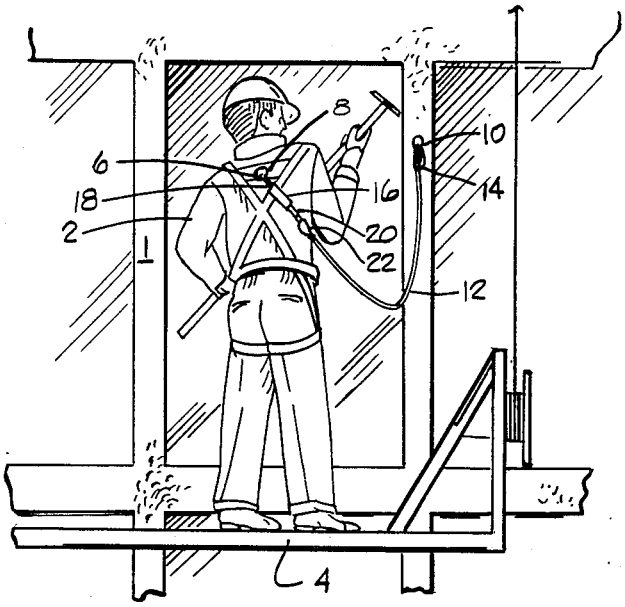
FIG. 1 illustrates one use for the invention.

In FIG. 1, there is illustrated one use of the invention described in this application. A workman 2 standing on a scaffold 4 is provided with a safety harness 6 having a hook 8. An anchor 10 is provided on the building and a lanyard 12 has one end 14 secured to the anchor 10. A shock absorber 16 has one end 18 thereof secured to the hook 8 and the other end 20 secured to the other end 22 of the lanyard 12. As explained below, either end 18 or 20 of the shock absorber 16 may be secured either to the hook 8 or to the other end 22 of the lanyard 12. Also, in some instances it may be desirable to attach either end 18 or 20 of the shock absorber 16 to the anchor 10 so that the lanyard 12 extends between the shock absorber 16 and the hook 8. All embodiments of the invention, as described below, are suitable for use as the shock absorber 16. However, it is understood that this illustrates only one use of the invention which is capable of many other uses.

Figure 2:
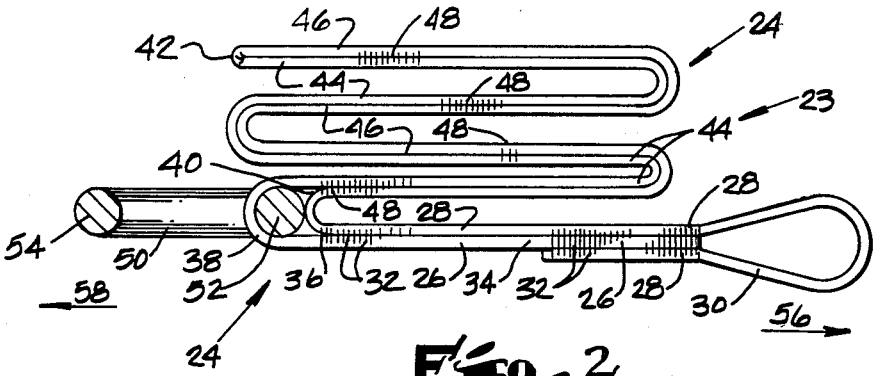
FIG. 2 is a schematic illustration of one embodiment of the invention.

The embodiment of the invention illustrated in FIG. 2 comprises apparatus 23 comprising an elongated continuous strip 24 of webbing having one end portion 26 and a second end portion 28. The second end portion 28 is looped around the end portion 26 to form a loop 30 which may be used to secure the apparatus 23 to a first object (not shown). The end portions 26 and 28 are superposed to form a lamination of three layers and rows of stitches 32 are used to secure them together in the superposed relationship. Sufficient rows of stitches 32 are made to insure that the end portions 26 and 28 will not separate when a force is placed on the loop 30 as described below. Some of the rows of stitches 32 are extended through the superposed end portions 26 and 28 from the location 34 to the location 36. A closed loop 38 is formed using a length of the end portion 26 and a length of the end portion 28 from the location 36 to the location 40. The remaining portion of the elongated continuous strip 24 of webbing is folded in half at 42 to provide superposed sections 44 and 46. The superposed sections 44 and 46 are secured together by rows of stitches 48 extending from the fold 42 to the location 40. Although in the preferred embodiment, stitches 48 are used to secure the superposed sections 44 and 46 together, it is understood that other means, such as an adhesive, may be used to secure the superposed sections 44 and 46 together.

A ring 50 has one portion 52 located in the loop 38 and, as described below, is used as a separating means. Another portion 54 of the ring 50 may be used to secure the apparatus 23 to a second object (not shown). In operation, the loop 30 or the portion 54 will remain in a relatively fixed location.

The embodiment of the invention illustrated in FIG. 2 starts to operate when a force of sufficient magnitude is applied so as to cause relative movement between the loop 30 and the portion 54 of the ring 50 in a direction away from one of them as illustrated by either of the arrows 56 and 58. This relative movement causes the superposed sections 44 and 46 to be pulled over the separating means 52. The successive stitches 48 are broken as the superposed sections 44 and 46 are pulled over the separating means 50 so as to generate a counteracting force until the force causing the relative movement between the loop 30 and the portion 54 has been overcome and the relative movement has been stopped. In the preferred embodiments of the invention, the force causing the relative movement between the loop 30 and the portion 54 will be overcome before all of the stitches 48 have been broken.

Figure 3:
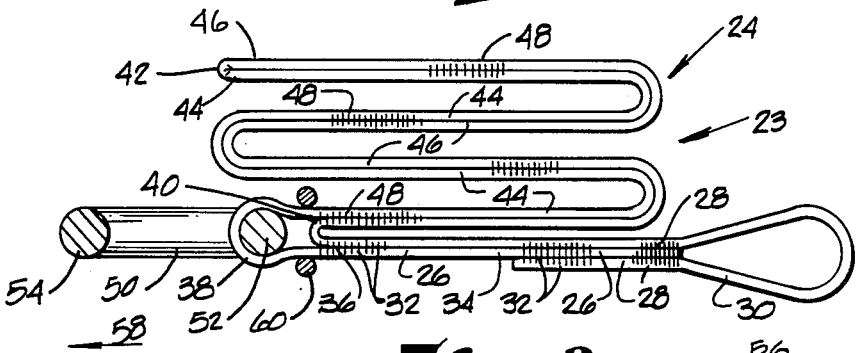
FIG. 3 is a schematic illustration of another embodiment of the invention.

The embodiment of the invention illustrated in FIG. 3 adds to the embodiment of the invention in FIG. 2 a friction applying means. The various elements in FIG. 3 corresponding to the same elements in FIG. 2 have been given the same reference numerals. Also, since the description of these elements is the same as above, it will not be repeated. The friction applying means comprises a ring 60 in contact with the spaced apart areas superposed section 44 after it has been separated by the separating means 52. The spaced apart areas of contact are located before and after the separating means 52. The ring 60 functions to insure contact between the separated superposed section 44 and the separating means 52 to generate a frictional force which cooperates with the counteracting force generated by the breaking of the stitches 48 to overcome the force causing the relative movement between the loop 30 and the portion 54.

Figure 4:
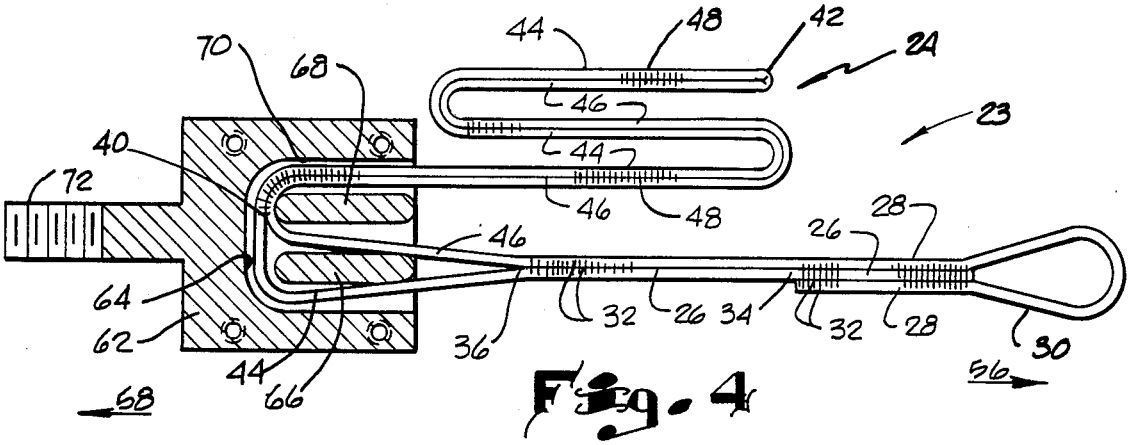
FIG. 4 is a schematic illustration of another embodiment of the invention.

In the embodiment of the invention illustrated in FIG. 4, the same reference numerals and description used in relation to FIG. 2 are used on corresponding elements. Instead of the ring 50, this embodiment uses a block 62 having a cavity 64. A pair of spaced apart, parallel oblong rods 66 and 68 are fixedly mounted on the block 62 and extend across the cavity 64. The superposed sections 44 and 46 enter into the cavity 64 and pass between one side of the oblong rod 68 and the adjacent side wall 70 of the cavity 64. The stitches 32 end at location 36 and the stitches 48 end at location 40 so that lengths of each end portion 26 and 28 cooperate to form a loop 38 around the oblong rod 66, which oblong rod 66 functions as the separating means. The block 62 is provided with a threaded stem 72 for securing the block 62 to an object. It is understood that any type of securing means can be substituted for the threaded stem 72. In operation, the loop 30 or the block 62 will remain in a relatively fixed location.

When a force of sufficient magnitude is applied so as to cause relative movement between the loop 30 and the block 62 in a direction away from one of them, as illustrated by either of the arrows 56 and 58, the superposed sections 44 and 46 are pulled over the separating means 66. As described above, as the superposed portions 44 and 46 are pulled over the separating means 66, successive stitches 48 are broken so as to generate a counteracting force until the force causing the relative movement has been overcome and the relative movement between the loop 30 and the block 62 has been stopped. A frictional force is also generated in the embodiment of FIG. 4. The relative movement between the loop 30 and the block 62 causes close contact between the superposed section 46 and the oblong rod 68 so that as the superposed sections 44 and 46 are pulled over the oblong rod 68, a frictional force is generated which frictional force cooperates with the counteracting force generated by the breaking of the stitches 48 to overcome the force causing the relative movement between the loop 30 and the block 62.

Figure 5:
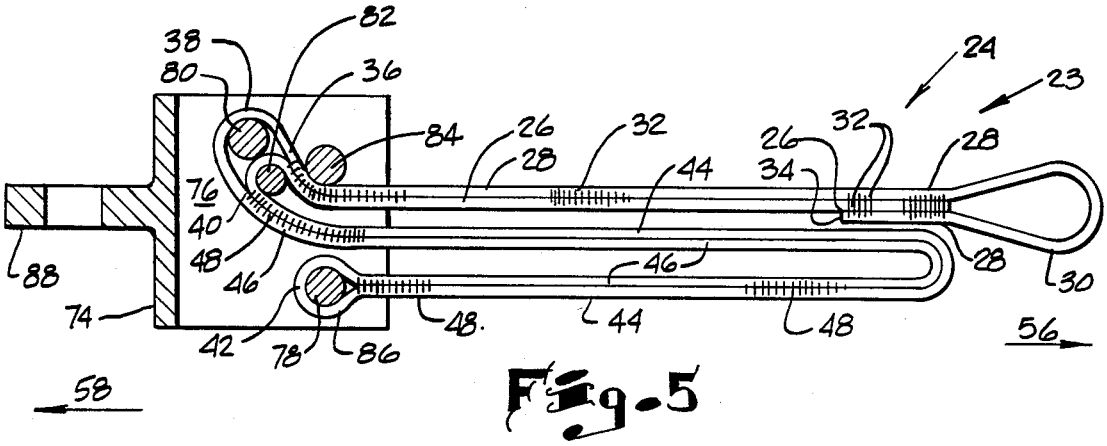
FIG. 5 is a schematic illustration of another embodiment of the invention.

In the embodiment of the invention illustrated in FIG. 5, the same reference numerals and description used in relation to FIG. 2 are used on corresponding elements. Instead of the ring 50, this embodiment uses a block 74 having a cavity 76. A plurality of rods 78, 80, 82, and 84 are fixedly mounted on the block 74 and extend across the cavity 76. A loop 86 is formed adjacent the fold 42 and is positioned around the rod 78 so as to anchor the superposed sections 44 and 46 on the block 74. The superposed portions 44 and 46 enter the cavity and are in contact with a portion of the surface of the rod 82. The stitches 32 end at location 36 and the stitches 48 end at location 40 so that lengths of each end portion 26 and 28 cooperate to form the loop 38 which passes around the rod 80 which functions as the separating means. After the superposed portions 44 and 46 have been separated, as described below, the separated sections 44 and 46 in a superposed relationship will pass between rods 82 and 84. The block 74 is provided with a ring 88 for securing the block 74 to an object. It is understood that any type of securing means can be substituted for the ring 88. In operation, either the loop 30 or the block 74 will remain in a relatively fixed location.

When a force of sufficient magnitude is applied so as to cause relative movement between the loop 30 and the block 74 in a direction away from one of them, as illustrated by either of the arrows 56 and 58, the superposed sections 44 and 46 are pulled over the separating means 80. As described above, as the superposed portions 44 and 46 are pulled over the separating means 80 successive stitches 48 are broken so as to generate a counteracting force until the force causing the relative movement between the loop 30 and the block 74 has been overcome and the relative movement has been stopped. Two frictional forces are generated in the embodiment of FIG. 5. The relative movement between the loop 30 and the block 74 causes close contact between the superposed section 44 and the rod 82 so that as the superposed sections 44 and 46 are pulled over the rod 82 a frictional force is generated. After the superposed sections 44 and 46 have been separated, they pass between rods 82 and 84 and the separated section 46 is in contact with the rod 84. The relative movement between the loop 30 and the block 74 causes close contact between the separated section 46 and the rod 84 so that as the separated section 46 is pulled over the rod 84, a frictional force is generated. The frictional forces generated at the rods 82 and 84 cooperate with the counteracting force generated by the breaking of the stitches 48 to overcome the force causing the relative movement between the loop 30 and the block 74.

Figure 6:
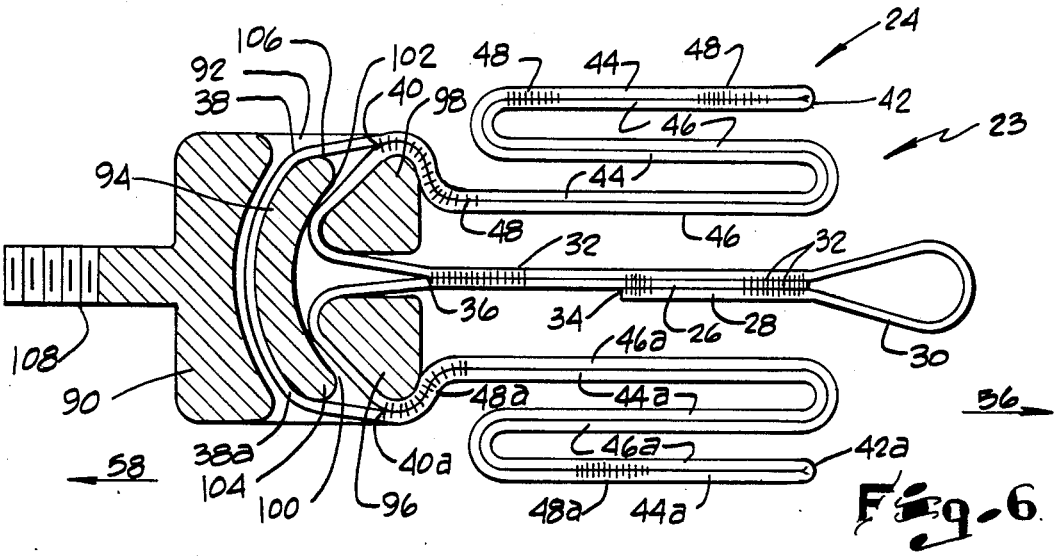
FIG. 6 is a schematic illustration of another embodiment of the invention.

In the embodiment of the invention illustrated in FIG. 6, the same reference numerals and description used in relation to FIG. 2 are used on corresponding elements. Since the embodiment of FIG. 6 has two superposed sections 44 and 46, the second superposed sections are identified with the letter "a". Instead of the ring 50, this embodiment uses a block 90 having a cavity 92. An arcuate rod 94 and two generally triangularly shaped rods 96 and 98 are fixedly mounted on the block 90 and extend across the cavity 92. The rods 96 and 98 are positioned relative to rod 94 so as to form narrow passageways 100 and 102 therebetween, which passageways 100 and 102 are slightly wider than the thickness of either of the superposed sections 44 or 46. The stitches 32 end at location 36 and the stitches 48 and **48*a* end at locations 40 and 40*a* so that a length of each end portion 26 and 28 cooperate to form two loops 38 and 38*a* passing around rods 96 and 98 and the rod 94. The ends 104 and 106 of the rod 94 each act as a separating means, as described below. After the superposed portions 44 and 46 and 44*a* and 46*a* have been separated, the section 46 passes over the rod 98 and the section 46*a* passes over the rod 96. The block 90 is provided with a threaded stem 108 for securing the block to an object. It is understood that any type of securing means may be substituted for the threaded stem 108. In operation, either the loop 30 or the block 90** remains in a relatively fixed location.

When a force of sufficient magnitude is applied so as to cause relative movement between the loop 30 and the block 90 in a direction away from one of them, as illustrated by either of the arrows 56 and 58, the superposed sections 44 and 46 are pulled toward separating means 106. At the same time, the superposed sections **44*a* and 46*a* are pulled toward the separating means 104. As the relative movement between the loop 30 and the block 90 is continued, the separated section 44 is pulled through the passageway 102 and the separated section 44*a* is pulled through the passageway 100. As the superposed sections 44 and 46 approach the separating means 106, successive stitches 48 are broken so as to generate a counteracting force. Also, as the superposed sections 44*a* and 46*a* approach the separating means 104, successive stitches 48*a* are broken so as to generate a counteracting force. Two frictional forces are also generated in this embodiment. The relative movement of the loop 30 and block 90 causes close contact between the separated section 46 and the rod 98 and between the separated section 46*a* and the rod 96 so that as the separated sections 46 and 46*a* are pulled over rods 96 and 98, they each generate a frictional force. These frictional forces are added to the above described counteracting forces generated by the breaking of the stitches. The counteracting forces are continued to be generated until the force causing the relative movement between the loop 30 and the block 90** has been overcome and the relative movement has been stopped.

Figure 7:
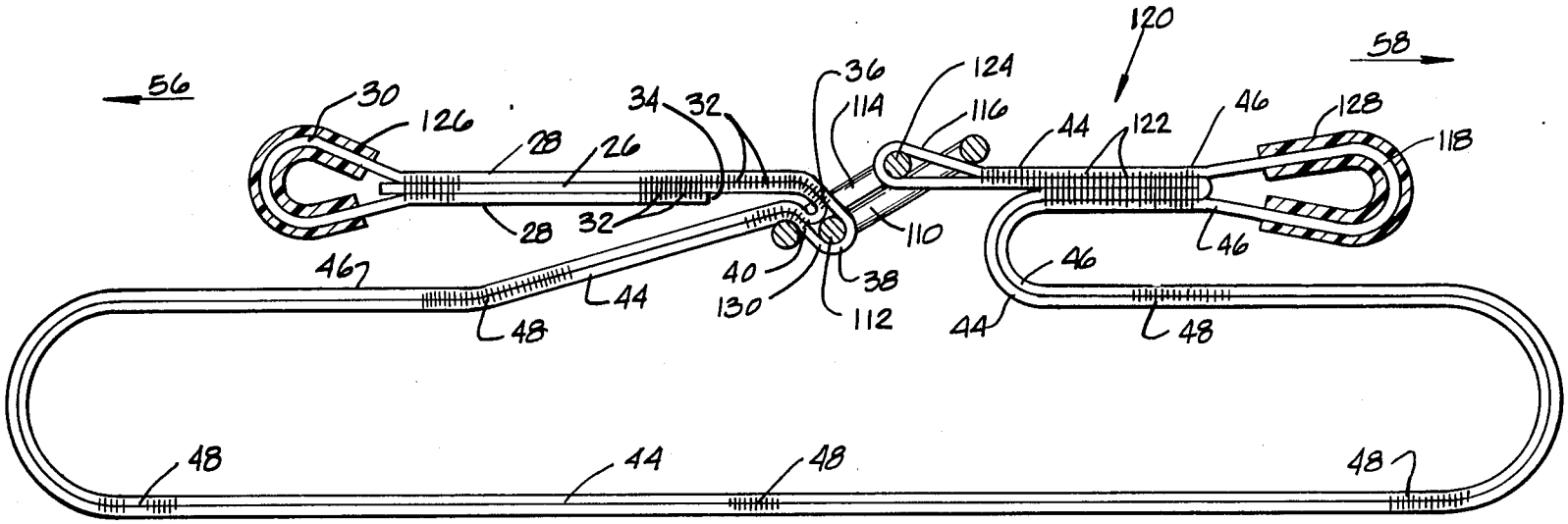
FIG. 7 is a schematic illustration of another embodiment of the invention.

In the embodiment of the invention illustrated in FIG. 7, the same reference numerals and description used in relation to FIG. 2 are used on corresponding elements. Instead of the ring 50, this embodiment uses a ring 110. The stitches 32 end at location 32 and the stitches 48 end at location 40 so that lengths of each end portion 28 and 28 cooperate to form in a loop 38. A portion 112 of the ring 110 is located in the loop 38 and functions as a separating means as described below. Another ring 114 is located adjacent to the ring 110 and has a surface in contact with a portion of superposed section 44. Instead of the fold 42, a portion of section 44 is formed into a loop 116 and a portion of section 46 is formed into a loop 118. The superposed sections 44 and 46 at location 120 are secured together by stitches 122. The loop 116 passes around a portion 124 of the ring 114 for a purpose described below. The loop 118 is adapted to be secured to an object (not shown). A tube 126 is positioned around the loop 30 and a tube 128 is positioned around the loop 118. The tubes 126 and 128 function to prevent or minimize wear on the loops 30 and 118. In operation, either the loop 30 or the loop 118 remains in a relatively fixed location.

When a force of sufficient magnitude is applied so as to cause relative movement between the loop 30 and the loop 118 in a direction away from one of them, as illustrated by either of the arrows 56 and 58, the superposed sections 44 and 46 are pulled over the separating means 112. As described above, as the superposed sections 44, and 46 are pulled over the separating means 112, successive stitches 48 are broken so as to generate a counteracting force. The relative movement between the loop 30 and the loop 118 causes ring 110 to be moved toward 114 or the ring 114 to be moved toward the ring 110 so as to pinch the portion 130 of the separated section 44 therebetween. As the separated section 44 is pulled between the rings 110 and 114, a frictional force is generated, which frictional force cooperates to counteract the force causing the relative movement between the loop 30 and the loop 118. The counteracting forces, generated by the breaking of the stitches 48 and the friction, are continued to be generated until the force causing the relative movement between the loop 30 and the loop 118 has been overcome and the relative movement has been stopped.

In some instances in the embodiment of FIG. 7, the ring 114 has a diameter smaller than the diameter of the ring 110 so as to insure the generation of large frictional forces. Also, it may be necessary to supply a lubricant, such as petroleum jelly, in the area of the portion 130 of the loop 38 to insure that the superposed portions 44 and 46 will commence to move when the force causing the relative movement between the loop 30 and the loop 118 is applied. Instead of the application of the lubricant at portion 130, the entire elongated strip 24 of webbing can be impregnated by a lubricant. This not only helps to insure movement of the superposed sections 44 and 46 but also provides protection against contamination of the elongated strip 24 of webbing.

Figure 8:
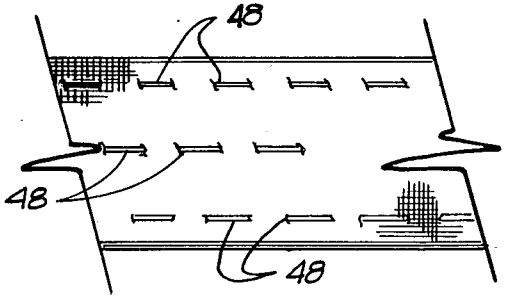
FIGS. 8, 8*a* and 8*b* are views illustrating different types of stitching for use in this invention.
Figure 8A:
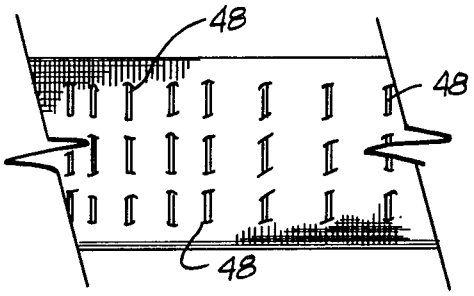
Figure 8B:
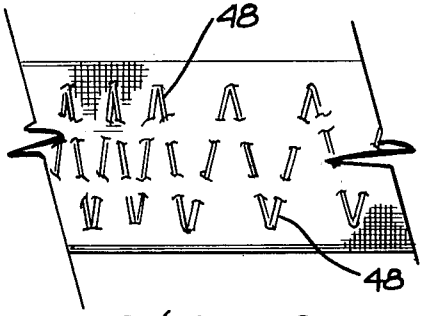

Various types of stitches 48 may be used to secure superposed sections 44 and 46 together, some of which are illustrated in FIGS. 8, 8*a* and 8*b*. In FIG. 8, the stitches 48 are in rows extending in a direction generally parallel to the longitudinal extent of the superposed sections 44 and 46. As illustrated in FIG. 8, two rows of stitches 48 are used in the portion of superposed sections 44 and 46 closer to the separating means. The stitching 48 is then increased to three rows and if desired can be increased to more than three rows. This construction permits the counteracting force to be increased gradually and more uniformly. In the embodiment of FIG. 8*a*, the rows of stitches 48 extend perpendicular to the longitudinal extent of the superposed sections 44 and 46. Also, the rows of stitches are spaced further apart in the portion of the superposed sections 44 and 46 closer to the separating means. In the embodiment of FIG. 8*b*, the stitches 48 extend in zig-zag directions which are spaced further apart in the portions of the superposed sections 44 and 46 closer to the separating means 112. It is understood that, if desired, the rows of stitches may be uniformly spaced apart.

Figure 9:
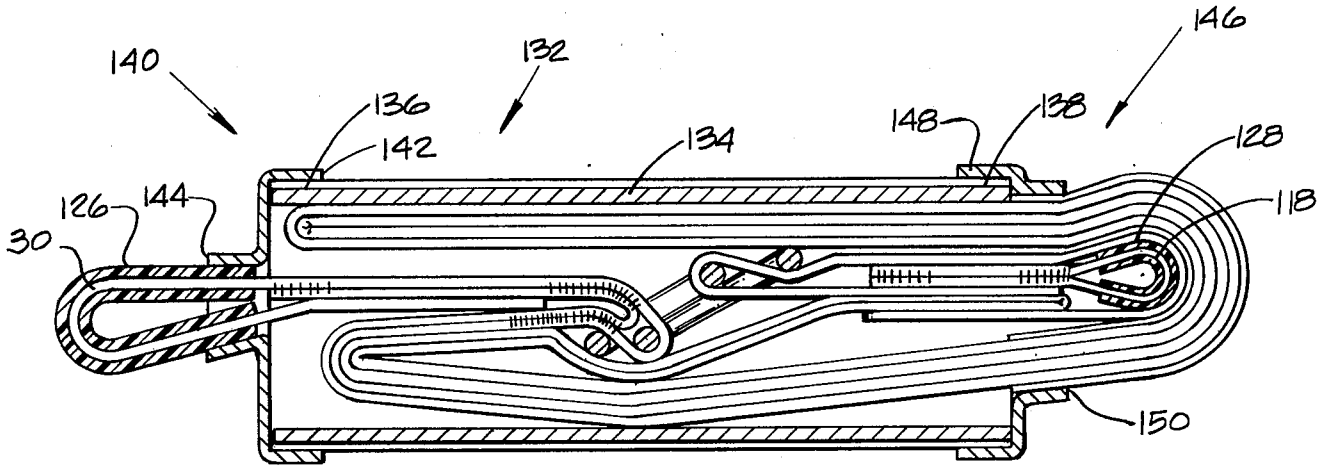
FIG. 9 is a schematic illustration of the invention in a container.

In FIG. 9, the embodiment of the invention is illustrated as being coiled up and positioned in a container 132 comprising a hollow tube 134. The embodiment of FIG. 7 is coiled so that the loop 30 extends out of one end 136 of the tube 134 and the loop 118 extends out of the other end 138 of the tube 134. A cover 140 is placed around the one end 136 of the tube 134 and has a portion 142 in contact with the side wall of the tube 134 and an opening 144 around the loop 30. A cover 146 is placed around the other end 138 of the tube 134 and has a portion 148 in contact with the side wall of the tube 134 and an opening 150 around the loop 118 and portions of the coiled webbing.

Figure 11:
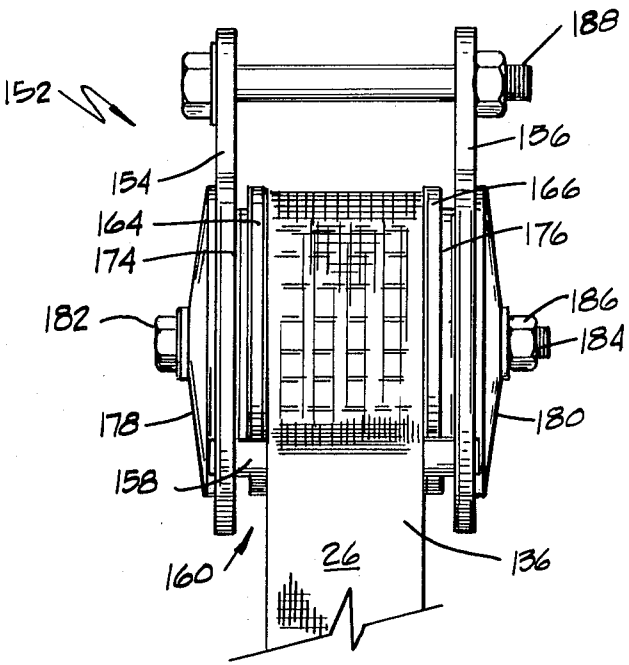
FIG. 11 is another view of FIG. 10 looking from line 11—11.
Figure 10:
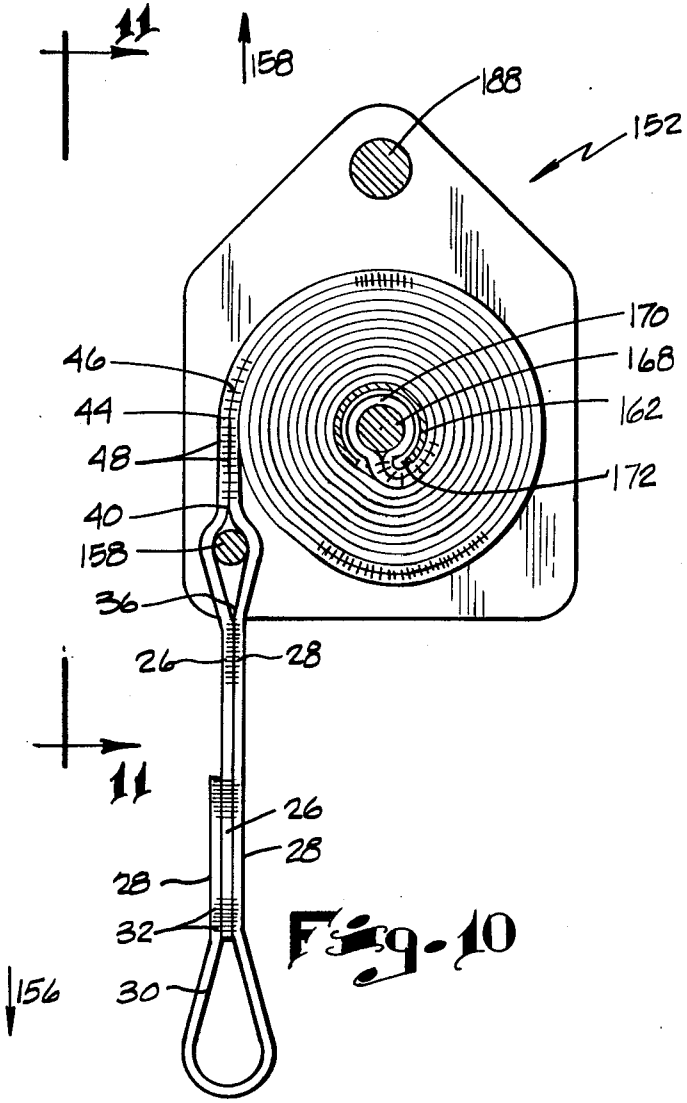
FIG. 10 is a schematic illustration of another embodiment of the invention.

In the embodiment of the invention illustrated in FIGS. 10 and 11, the same reference numerals and description used in relation to FIG. 2 are used on corresponding elements. Instead of the ring 50, this embodiment utilizes a unit 152 having a pair of spaced apart plates 154 and 156. A rod 158 extends between and is secured to the plates 154 and 156. The rod 158 functions as the separating means, as described below. A drum 160 having a central portion 162 and two rims 164 and 166 is mounted for rotation between the plates 154 and 156 on an axle 168. The superposed sections 44 and 46 are wrapped around the central portion 162 and a loop 170 at the end of the superposed sections 44 and 46 is passed through an opening 172 in the central portion 162. The axle 168 passes through the loop 170. Friction means 174 and 176 are located between the rim 164 and the plate 154 and between the rim 166 and the plate 156. Pressure plates 178 and 180 are located against the plates 154 and 156. The axle 168 has a bolt head 182 and a threaded stem 184 on which is threaded a nut 186. This construction permits the friction produced by the friction means 174 and 176 against the rotation of the rims 164 and 166 to be varied as desired by rotation of the nut 186 which varies the amount of pressure exerted by the pressure plates 178 and 180 against the plates 154 and 156. A removable bolt 188 is provided for securing the unit 152 to an object. It is understood that other types of securing means may be substituted for the removable bolt 188. In operation, either the loop 30 or the unit 152 remains in a relatively fixed location.

Prior to being placed in position to be used, the nut 186 is adjusted so as to produce the proper amount of force on the pressure plates 178 and 180 so that the proper amount of frictional force will be developed by rotation of the rims 164 and 166 against the friction mens 174 and 176.

When a force of sufficient magnitude is applied so as to cause relative movement between the loop 30 and the unit 152 in a direction away from one of them, as illustrated by either of the arrows 156 and 158, the superposed sections 44 and 46 are pulled over the separating means 158. As described above, as the superposed sections 44 and 46 are pulled over the separating means 158, successive stitches 48 are broken so as to generate a counteracting force. The counteracting forces, generated by the breaking of the stitches 48 and the frictioned force generated by the friction means 174 and 176, are continued to be applied until the force causing relative movement between the loop 30 and the unit 152 has been overcome and the relative movement has been stopped.

In one embodiment of the invention as illustrated in FIG. 7, the elongated strip 24 of webbing is formed using KEVLAR fiber. KEVLAR is a registered trademark of E. I. DuPont De Nemours & Co. for their brand of polyazimide fiber. The webbing is about 1.0 inches wide, extends in the longitudinal direction a distance of about 75.0 inches and has a thickness of about 1/16 inches. The superposed sections 44 and 46 between the location 40 and the stitching 122 have a longitudinal extent of about 30 inches. The distance between the end of the loop 30 and the location 36 is about 8.75 inches. The loop 30 is formed so that securing means having a cross-sectional configuration as great as about 1.0 square inches can be passed therethrough. The rings 110 and 114 are formed from steel having a thickness of about 0.1875 inches with the ring 110 having an internal diameter of about 0.875 inches and the ring 114 having an internal diameter of about 0.750 inches. The stitches 32, 48 and 132 are made using KEVLAR thread marketed by Robinson Thread Co. The loop 118 is formed so that securing means having a cross-sectional configuration as great as 1.0 square inches can be passed therethrough. The tubes 126 and 128 were formed from nylon web tubing and has a longitudinal extent of about 1.5 inches. The webbing 2 is impregnated with a petroleum jelly marketed by Cheesebraugh Ponds Inc. This unit is designed so that the largest generated counteracting force will be less than about 500 pounds. The container 132 comprises a hollow tube 134 having a cross-sectional area of about 1.0 square inch and a longitudinal length of about 6.0 inches. The covers are formed from poloyolefins heat shrink tubing and are placed around the loops 30 and 118 and the ends 136 and 138 and heat shrunk in place. The foregoing example is given for illustration purposes only and it is understood that different materials and dimensions may be used for other uses of the invention.

All of the embodiments of the invention have been illustrated as they appear before the application of a force thereto. Also, it is understood that all of the embodiments will be marketed in packages similar to that illustrated in FIG. 9. When the embodiments of the invention are used in the manner illustrated in FIG. 1, the loop 30 is secured by conventional means either to the hook 8 or the end 22 of the lanyard 12. The other end of the apparatus, such as the ring 50, securing means 72, 88, 108, the loop 118 and the bolt 188, is secured by conventional means either to the hook 8 or the end 22 of the lanyard 12.

It is contemplated that the inventive concepts herein described may be variously otherwise embodied and it is intended that the appended claims be construed to include alternative embodiments of the invention except insofar as limited by the prior art.

What is claimed is:

1. Apparatus for applying a counteracting force comprising:

at least one elongated strip of webbing;

at least one portion of said at least one elongated strip of webbing folded over in superposed relationship to form first superposed sections;

means for securing said first superposed sections together in said superposed relationship;

means extending from one end of said first superposed sections for securing said one end to a first object;

at least one separating means located in said means extending from one end of said first superposed sections and positioned so that said separating means can pass between said first superposed sections;

means for securing said at least one separating means to a second object; and means for producing a force causing relative movement between said first and second objects in a direction away from one of them, said force being of sufficient magnitude so that said first superposed sections will be pulled over said at least one separating means and said at least one separating means will pass between said superposed sections and separate successive parts of said securing means of said first superposed sections to form first separated superposed portions of said first superposed sections and to generate a counteracting force until said force causing the relative movement between said first and second objects has been overcome and said relative movement has been stopped.

2. Apparatus as in claim 1 and further comprising:

means for generating a frictional force acting as a counteracting force against said force causing the relative movement between said first and second objects.

3. Apparatus as in claim 1 wherein:

said securing means for said first superposed sections becomes increasingly resistant to separation in a direction away from said one end of said first superposed sections.

4. Apparatus as in claim 1 wherein:

said at least one separating means comprises at least one rigid element.

5. Apparatus as in claim 1 and further comprising:

means adjacent the other end of said first superposed sections for securing said at least one separating means to said second object.

6. Apparatus as in claim 5 wherein:

said at least one separating means comprises a first rigid ring; and said friction applying means comprises a second rigid ring adjacent to said first rigid ring.

7. Apparatus as in claim 6 wherein:

said first and second rigid rings have configurations which are similar in shape but different in size.

8. Apparatus as in claim 6 and further comprising:

means for initiating movement of said first superposed sections in response to said sufficient force.

9. Apparatus as in claim 8 wherein:

said means for initiating movement comprises a lubricant in the area of said first and second rigid rings closer to said one end.

10. Apparatus as in claim 8 wherein:

said means for initiating movement comprises a lubricant impregnated into said at least one elongated strip of webbing.

11. Apparatus as in claim 8 and wherein:

said securing means for said first superposed sections becomes increasingly resistant to separation in a direction away from said one end of said first superposed sections.

12. Apparatus as in claim 11 wherein:

said securing means for said first superposed sections comprises stitching.

13. Apparatus as in claim 12 wherein:

said stitching comprises spaced apart, substantially parallel rows of stitching extending in a direction substantially parallel to the longitudinal axis of said first superposed sections.

14. Apparatus as in claim 13 wherein:

said at least one elongated strip of webbing is made using KEVLAR.

15. Apparatus as in claim 8 and further comprising:

means for confining a major portion of said first superposed sections to provide an additional counteracting force.

16. Apparatus as in claim 2 wherein:

said means for applying a frictional force comprises a ring having portions thereof located before and after said separating means; and each of said portions located to contact successive areas of at least one of said first separated superposed portions and to ensure contact between said at least one of said separated portions and said separating means to generate a frictional force as a result of movement of said at least one of said first separated superposed portions after the application of said sufficient force.

17. Apparatus as in claim 4 and further comprising:

means for applying a frictional force acting against at least one of said first separated superposed portions.

18. Apparatus as in claim 17 wherein:

said at least one rigid element is linear;

said means for applying a frictional force comprises at least a second rigid linear element extending substantially parallel to said at least one rigid, linear element of said at least one separating means, spaced a distance therefrom and secured in a relatively fixed relationship thereto; and said at least a second rigid linear element of said means for applying a frictional force located to contact successive areas of at least one of said first separated superposed portions and to apply a force thereto to generate said frictional force during said movement of said first separated superposed portions after the application of said sufficient force.

19. Apparatus as in claim 18 and further comprising:

said means for applying a frictional force comprises at least a third rigid linear element extending substantially parallel to said at least one rigid, linear element of said at least one separating means and said at least a second rigid linear element of said means for applying a frictional force spaced a distance from each and secured in a relatively fixed relationship thereto; and said at least third rigid linear element of said means for applying a frictional force located to contact successive areas of at least the other of said first separated superposed portions and to apply a force thereto to generate said frictional force during said movement of said first separated superposed portions after the application of said sufficient force.

20. Apparatus as in claim 4 and further comprising:

said at least one rigid element is linear;

a rotatable drum having an axis of rotation extending in a direction substantially parallel to said rigid, linear element of said separating means;

said first superposed sections coiled around said rotatable drum; and means for securing the other end of said at least one portion to said rotatable drum.

21. Apparatus as in claim 20 and further comprising:

means for applying a frictional force acting on said rotatable drum to resist rotation thereof.

22. Apparatus as in claim 21 and further comprising:

means for adjusting the amount of frictional force being applied by said means for applying a frictional force.

23. Apparatus as in claim 1 and further comprising:

at least a second portion of said at least one elongated strip of webbing folded over in superposed relationship to form second superposed sections;

means for securing said second superposed sections together in said superposed relationship;

at least a second separating means located between said second superposed sections and adjacent to said one end; and means for securing said second separating means to said second object so that said second superposed sections will be pulled over said at least a second separating means and said at least a second separating means will separate successive parts of said securing means of said second superposed sections to form second separated superposed portions of said second superposed sections and to generate a second counteracting force until said force has been overcome and the relative movement between said first and second objects has been stopped.

24. Apparatus as in claim 23 wherein:

said at least one separating means and said at least a second separating means are located at opposite ends of a rigid, arcuate element.

25. A method for applying a counteracting force comprising:

folding at least one portion of an elongated strip of webbing into superposed relationship comprising superposed sections;

securing said superposed sections together;

providing means adjacent to one end of said superposed sections for securing said one end to a first object;

locating at least one separating means in said means for securing one end to a first object and positioned to pass between said superposed sections;

securing said separating means to a second object;

producing a force causing relative movement between said first and second objects in a direction away from one of them, said force being of sufficient magnitude to pull said superposed sections over said at least one separating means;

generating a counteracting force by separating said secured together superposed sections as said superposed sections are pulled over said at least one separating means; and generating said counteracting force until said force has been overcome and said relative movement between said first and second objects has been stopped.

26. A method as in claim 25 and further comprising:

applying a frictional force in addition to said counteracting force until said force causing said relative movement between said first and second objects has been overcome.

27. A method as in claim 26 and further comprising:

increasing the resistance to separation at which said superposed sections are secured together in a direction away from said one end.

28. A method as in claim 27 and further comprising:

providing means adjacent to the other end of said first superposed sections for securing said at least one separating means to said second object.

* * * * *